US007341527B1

(12) United States Patent
Fisher

(10) Patent No.: US 7,341,527 B1
(45) Date of Patent: Mar. 11, 2008

(54) GOLF PUTTER WITH MULTIPLE STRIKING-SURFACES, REVERSIBLE FACE PLATE

(76) Inventor: Dale P. Fisher, 18055 Bushard, Fountain Valley, CA (US) 92708

( * ) Notice: Subject to any disclaimer, the term of this patent is extended or adjusted under 35 U.S.C. 154(b) by 311 days.

(21) Appl. No.: 11/165,111

(22) Filed: Jun. 22, 2005

(51) Int. Cl.
*A63B 53/04* (2006.01)

(52) U.S. Cl. ..... 473/329; 473/288; 473/340; 473/342; 473/251

(58) Field of Classification Search ..... 473/324–350, 473/288–291, 313–314, 244–255
See application file for complete search history.

(56) References Cited

U.S. PATENT DOCUMENTS

| | | | | | |
|---|---|---|---|---|---|
| 819,900 | A * | 5/1906 | Martin | 473/329 |
| 1,253,700 | A * | 1/1918 | McLaughlin | 473/288 |
| D238,285 | S * | 12/1975 | Ross | D21/739 |
| 4,121,832 | A * | 10/1978 | Ebbing | 473/335 |
| 4,422,638 | A * | 12/1983 | Tucker | 473/329 |
| 4,618,149 | A * | 10/1986 | Maxel | 473/245 |
| 4,884,808 | A * | 12/1989 | Retzer | 473/288 |
| 5,437,447 | A * | 8/1995 | Rigutto | 473/251 |
| 5,509,660 | A * | 4/1996 | Elmer | 473/288 |
| 5,921,871 | A * | 7/1999 | Fisher | 473/329 |
| 6,086,484 | A * | 7/2000 | Uebelhor | 473/251 |
| 6,227,986 | B1 * | 5/2001 | Fisher | 473/342 |
| 6,238,303 | B1 * | 5/2001 | Fite | 473/342 |
| 6,270,423 | B1 * | 8/2001 | Webb | 473/226 |
| 6,743,117 | B2 * | 6/2004 | Gilbert | 473/332 |
| 6,863,620 | B2 * | 3/2005 | Tucker, Sr. | 473/288 |
| 7,086,961 | B2 * | 8/2006 | Wright et al. | 473/329 |
| 2003/0216191 | A1 * | 11/2003 | Wright et al. | 473/288 |

* cited by examiner

*Primary Examiner*—Sebastiano Passaniti
(74) *Attorney, Agent, or Firm*—William L. Chapin

(57) ABSTRACT

A golf putter including a head which has detachably fastened to the body thereof a face plate provided with a plurality of striking surfaces which are selectably and interchangeably oriented by a player to a forward facing use position, the striking surfaces each having different ball-impacting characteristics, e.g., rebound factor, hardness, and/or frictional characteristics. In one embodiment, the face plate has flat front and rear parallel surfaces in which are fitted inserts with different ball-impacting characteristics, the face plate being attachable conformally to the front face of a putter head body with a selected insert in a forward-facing use position by a pair of screws inserted through holes in the face plate in opposite sides of the inserts and tightened into a pair of aligned threaded bores which extend perpendicular into the front face of the putter head body. In another embodiment, the face plate fits conformally into a recess provided in the front face of a putter head body, the recess being of sufficient depth to hold a single, double insert plate, or deeper to accommodate a pair of thin, rectangular cross-section double-insert face plates, or a square cross-section, quadruple-insert face plate in which two pairs of inserts are mounted in four lateral faces of the face plate.

25 Claims, 9 Drawing Sheets

20
19A
19
14
15
16
17
18
21
22
23
25
26
24
29

18
39
21
28
32
37
23
22
35
31
25
33
29
38
27
36
26
30

18
21
57
41
56
58
32
22
40
62
34
108
35
109
61
33
30
32
55
38
29

GOLF PUTTER WITH MULTIPLE STRIKING-SURFACES, REVERSIBLE FACE PLATE

BACKGROUND OF THE INVENTION

A. Field of the Invention

The present invention relates to the game of golf in which golf clubs are swung by a player to impact and propel a golf ball. More particularly, the invention relates to an improved golf putter which has a detachable face plate provided with a plurality of striking surfaces which are selectably and interchangeably orientable to a forward-facing ball impacting disposition, the striking surfaces having different ball-impacting characteristics.

B. Description of Background Art

In theory, golf is a simple game, merely requiring a player to advance a ball from a tee located at the beginning of a fairway into a cup or "hole" located on a green at the end of a fairway. This is done by successively hitting the ball with a selected club a minimum number of times, or strokes to thereby impart momentum to the ball and thus propel it in an airborne trajectory directed towards the green. The progression from tee to green is repeated for the nine or eighteen seriatim fairways or holes which the particular golf course is segmented into. In practice, however, the game of golf can be very frustrating, for a number of reasons.

For long holes, beginning golfers frequently experience problems with their "long game," i.e., have difficulty in hitting the ball squarely with sufficient force to traverse the fairway from tee to green with a minimum number of strokes. However, for most people that are not physically handicapped, a facility for hitting "long" balls can be developed in a relatively short time, by practicing at driving ranges, for example. On the other hand, beginning golfers often find that, although the skills required to advance the ball from the tee to a green in a reasonable number of strokes can be achieved in a relatively short time, putting the ball into the cup by impacting the ball to give it an appropriate rolling trajectory can add a sufficient number of strokes to significantly exceed "par," the idealized, average number of strokes determined to be achievable by expert golfers playing the same hole.

Oftentimes, beginning golfers add excessive strokes to their game because of difficulties experienced in putting the ball into the cup from distant locations on the green. Putting difficulties can arise from the fact that a different set of motor skills are required for putting than for driving the ball from the tee, or hitting long fairway shots. The latter require expenditure of substantial amounts of kinetic energy by the golfer in imparting enough momentum to the ball to propel it for long distances. In putting, raw power or brute force is ineffectual, and the beginning golfer must acquire a substantial amount of finesse in hitting a ball residing on the green, to avoid overshooting the cup and adding unwanted strokes to his game.

Since the amount of momentum that must be imparted to a putted ball is so much less than required to drive a ball appreciable distances, beginning golfers often "pull" their club on short putts, i.e., fail to follow through on their stroke. This pulling or "choking" is detrimental, since the directional control of the impacted ball is adversely affected by such actions. Accordingly, many beginner golfers are confronted with the frustrating situation of putting the ball with good accuracy but beyond the cup, when utilizing their newly acquired skills for long-ball hitting with appropriate follow-through in their stroke. Conversely, choked or pulled strokes can result in the putted ball stopping short of the cup, or deviating substantially away from the cup.

The putting difficulties alluded to above are exacerbated by the substantial variations normally encountered in the conditions of greens. Thus, greens on which the grass is closely trimmed and dry offer minimum rolling resistance to a golf ball, and are "fast." Conversely, greens on which the grass is long and/or wet present substantial frictional resistance to a rolling golf ball, and are "slow." Therefore, the exact amount of momentum that must be delivered to hole a ball varies substantially as a function of green conditions, as well as with distance from the cup.

In recognition of the problems encountered with putting by beginners as well as even relatively experienced golfers, the present inventor disclosed a novel putter design to improve putting skills, in U.S. patent application Ser. No. 08/416,135 filed Apr. 5, 1995, now U.S. Pat. No. 5,458,332, issued Oct. 17, 1995, for a Golf Putter Head With A Cushioning Face. That patent discloses heads having on the front face thereof a polymer pad which has a rebound factor directly related to the distance to an intended target. For short putts and/or fast greens, a small rebound factor of, say 12.5% was disclosed as being desirable for putts of about 10 feet, 25% for 15-20 foot putts, 37.5% for putts of about 30 feet, and 50% for putts of 40 feet or greater.

By selecting a particular putter from a series of putters fitted with inserts having different rebound factors, the disclosed invention enabled golfers to utilize strokes that varied over a smaller power range, even for widely varying putting distances and green conditions. For example, by using a putter having an insert with a low rebound factor of 12.5%, the ball may be struck with nearly the same vigor for a 10-foot putt as for a 40-foot putt using a putter having a higher rebound factor of 50%. Therefore, the player can use a complete stroke with the follow-through required for accurately launching the ball towards the cup, even for short putts and/or fast greens, by using a putter having an insert with an appropriately low rebound factor.

In addition to the substantial contribution to improved putting afforded by putters having inserts with rebound factors optimized to various putting situations, the present inventor's prior patent disclosed putters in which the rebound factor of an insert could be varied somewhat independently of hardness. This capability permits the feel of the club upon impacting the ball to be adjusted somewhat, thus allowing inserts with varying rebound factors to provide similar sensory feedback upon impacting a golf ball.

The golf putter heads described in the present inventor's U.S. Pat. No. 5,458,332 referred to above provided a substantial contribution to improving a golfer's putting performance. However, a problem still existed for golfers approaching the green.

In the "short" portion of a golf game, it is usually necessary to hit the ball onto the green from a fairway, rough or sand trap. Such locations are oftentimes well within a golfer's maximum distance hitting capability. Accordingly, clubs with an inclined front face that provide a substantial vertical component (loft) to the ball trajectory are often used in approaching the green. A high trajectory minimizes the likelihood of overshooting the green, and results in the ball impacting the green at a relatively steep angle, thereby minimizing roll away from the impact point. In spite of a careful choice of the best club to prevent exceeding a desired horizontal range, many players are confronted in their short games with the same dilemma as in putting; namely, maintaining normal swing and follow through to achieve good trajectory direction, and possibly overshooting an intended impact point, or pulling the shot to decrease horizontal range, while adversely affecting angular or bearing accuracy, and/or falling short of a desired impact point.

In view of the problems alluded to above, it occurred to the present inventor that some of the novel improvements which he disclosed in his U.S. Pat. No. 5,458,332, for putters might be adapted to other varieties of golf clubs, including wedges and other irons, as well as woods. Such considerations were in part a motivation for further inventions by the present inventor, which were disclosed in U.S. patent application Ser. No. 08/543,813, filed Oct. 16, 1995, now U.S. Pat. No. 5,674,132, issued Oct. 7, 1997 for a golf club head with a rebound control insert.

In the course of applying the improvements in putter construction disclosed in the '332 patent to other types of golf clubs, it was found that the larger ball-impact forces typically encountered in using irons and woods suggested a somewhat more rugged design, to ensure that the polymeric insert on the club face could be attached securely to a club head, and by a relatively simple manufacturing technique. As it turned out, the newly conceived design for improved woods and irons turned out to be advantageously useable with the putter head design previously disclosed by the present inventor.

Following the aforementioned advancements in golf club design, the present inventor conceived a golf putter including a head provided with an insert which may be readily interchanged to provide different rebound factors and/or hardness, resulting in issuance of U.S. Pat. No. 5,921,871, Golf Putter Head With Interchangeable Rebound Control Insert. The golf putter disclosed in the '871 patent includes a head having at the front face thereof a resilient rebound control pad secured to the head by releasable fastening means that permit interchanging the pad with a pad which provides a different rebound factor and/or hardness. Thus, the putter disclosed in the '871 patent enables different rebound factors to be selected to suit a player's particular putting style. For example, a consistently heavy hitter might choose a lower rebound factor, to avoid overstroking a hole. On the other hand, the same player might choose a higher rebound factor for use on a particular day at a particular course when the greens were slower, because the grass was wet and/or longer. Different hardness values may also be selected to provide a different feel upon impacting a ball.

In U.S. Pat. No. 6,695,708, the present inventor disclosed a Golf Putter With Polyhedral Head And Rotatably Selectable Traction Control Faces, which included a polyhedrally-shaped head provided with a plurality of generally vertically disposed ball-impacting faces which ball impacting characteristics, such as rebound, hardness or traction control differed for the different faces. The head is rotatable with respect to a handle shaft of a golf club, and fixable to the shaft at discrete, keyed orientation angles, to thereby position a selected face in a front, ball impacting disposition relative to the handle. The present invention was conceived of to provide a golf putter which has a head to which is attached a face plate that has a plurality of striking faces, each of which has different ball-impacting characteristics, and which are selectably positionable to a front ball-impacting disposition by a player by removing, rotating, and re-attaching a reversible face plate to the body of a putter head.

OBJECTS OF THE INVENTION

An object of the present invention is to provide a golf putter which includes an elongated shaft that has at an upper end thereof a handle grip and, attached to a lower end of the shaft, a putter head to which is removably attached a reversible face plate that has a plurality of different striking surfaces, each of which has different ball-impacting characteristics, the different striking surfaces being selectably positionable to a forward facing use position by a player.

Another object of the invention is to provide a golf putter head which includes a body that has a hosel protruding upwardly from the body for attachment to the lower end of a golf putter shaft, and which has a reversible face plate releasably attached to a front face of the body.

Another object of the invention is to provide a golf putter head which includes a body and a thin, rectangular cross-section face plate provided with two opposite parallel faces that have different ball-impacting characteristics, the face plate being releasably and reversibly attachable to the front surface of the body to thereby interchangeably position either of the two faces in a forward facing use position.

Another object of the invention is to provide a golf putter head which includes a body that has formed in a front face wall thereof a shallow depression or recess in which a thin face plate provided with two opposite parallel faces that have different ball-impacting characteristics is reversibly and releasably secureable with a selected face in a front facing ball-impacting disposition.

Another object of the invention is to provide a golf putter head which includes a body that has formed in a front surface thereof a shallow recess for reversibly holding a two-sided, dual striking-surface face plate, and a pocket located inwardly of the depression for releasably holding weighting members of selected weights and selected locations within the pocket.

Another object of the invention is to provide a golf putter head which includes a body that has formed in a front face thereof a relatively deep recess in which is releasably securely a stack of two face plates each having a pair of faces that have different ball-impacting characteristics, a selected one of the face plates being interchangeably and releasably secured within the recess with a selected face in a forward-facing ball-impacting disposition.

Another object of the invention is to provide a golf putter head which includes a body that has formed in a front face thereof a relatively deep recess in which is releasably secured a stack of two thin, rectangular cross-section face plates each having a pair of faces with different ball-impacting characteristics, or alternatively, a four-sided, square cross-section face plate which has four different ball-impacting faces, with a selected one of the four faces of the two rectangular face plates or of the single four-sided, square face plate in a forward-facing, ball-impacting disposition.

Another object of the invention is to provide a golf putter head which includes a body that has formed in a front surface thereof a recess in which is releasably secureable at least one face plate having a plurality of faces that have different ball-impacting characteristics, the face plate being interchangeably and releasably secureable within the depression with a selected face disposed in a forward-facing ball-impacting orientation.

Another object of the invention is to provide a golf putter head which includes a body that has formed in a front surface thereof a recess in which is releasably secureable at least one face plate having a plurality of faces that have different ball-impacting characteristics, the face plate being interchangeably and releasably secureable within the recess with a selected face disposed in a forward-facing ball-impacting orientation, the body having through an upper wall surface thereof a sighting aperture through which a part of an upper surface of a face plate is viewable.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends an improved golf putter that includes a head to which is removably attached a reversible face plate that has a plurality of different striking surfaces, each of which has different ball-impacting characteristics, the different striking surfaces being interchangeably positionable by a player to a forward-facing ball-impacting position. The differing ball-impacting characteristics may include hardness and/or rebound factor, and are preferably provided by including in each striking surface an insert which differs from inserts in other striking surfaces in material properties, and/or thickness.

A basic embodiment of a golf putter head with multiple striking-surfaces, reversible face plate according to the present invention includes a block-like body that has a horizontally elongated, generally rectangularly-shaped vertically disposed front face. The putter head body has a generally flat lower sole surface, which may have a slightly convex curvature, and an upper crown surface from which protrudes a shank or hosel for attachment to the lower end of a golf club shaft. Although the hosel may protrude from any desired location at any desired angle from the upper or crown surface of the putter head, preferably, the hosel is offset from a vertical fore-and-aft center plane of the putter head body to a location closer to one of two laterally spaced apart opposite upwardly disposed side walls of the body, which is designated as the heel, the opposite side wall being designated as the toe. Optionally, the heel and toe side walls are angled inwardly at equal, slightly acute angles relative to the sole surface of the putter head body, the angles being equal to thereby make the front, generally vertically disposed face of the body laterally symmetric about a vertical fore-and-aft center plane of the body.

The face plate for use in a basic embodiment of a golf putter with multiple striking surfaces, reversible face plate according to the present invention has a shape which is generally congruent with that of the front face of the putter head body. The face plate has in front elevation view a shape which is laterally symmetric with respect to a fore-and-aft vertical center plane through the face plate. Thus, for use with a putter head body having a generally rectangular front elevation-view shape, the face plate has a laterally elongated, rectangularly front elevation-view shape, while face plates for use with symmetrically angled heel and toe side walls would also have symmetrically angled heel and toe sides. Moreover, reversible face plates for a basic embodiment of a putter head which has convex, arcuately curved sides would have a similarly-shaped lower surface.

A preferred embodiment of a two-sided face plate for use with a basic embodiment of a putter head according to the present invention has a uniform thickness, and notches of equal shape and size formed in front and rear, opposite planar side walls of the plate, in which are secured inserts of different material properties and/or thicknesses. Preferably, the thickness of each insert and the depth of the notch into which it is secured, e.g., by an adhesive cement, have substantially the same dimensions, so that the front surface of the insert is coplanar, i.e., flush with the adjacent uncut surface of the plate. Each insert may consist of unitary plate of material such as a polymer or a metal, or a laminated stack of plates made of a polymers and/or metals. Although the outline or elevation-view shape of the notch and insert are not critical, a preferred shape is that of a laterally symmetric trapezoid.

The reversible face plate of a basic embodiment of a putter head according to the present invention is releasably attached congruently to the front face of the putter head body by any suitable means. In a preferred embodiment, the face plate is releasably secured to the front face of the putter head body by a pair of flat-head allen i.e., socket screws which are inserted through a pair of countersunk through-holes provided through the face plate at laterally opposed sides of the notches and inserts, the screws being tightened into a pair of aligned, threaded blind bores which extend into the front face of the putter head body. This construction enables the face plate to be removed, reversed, and re-fastened to the front face of the putter head body as desired by a player to suit different greens conditions at the beginning of a round of golf, but not so quickly or easily as to facilitate reversing the face plate during a round of golf, in violation of USGA rules.

Preferred embodiments of golf putter heads with multiple striking-surfaces, reversible face plates according to the present invention have a depression, recess or well formed in the front face of the putter head body. The recess preferably has a uniform cross-section and extends inwardly or rearwardly from the front face of the putter head body, has a laterally elongated, rectangular front elevation view shape, and terminates in a flat rear or inner wall surface. A preferred embodiment of a putter head according to the present invention includes a face plate which has notches in front and rear parallel faces thereof in which are conformally fastened front and rear inserts that have different ball-impacting characteristics.

One type of dual-sided, dual insert face plate for use with a putter head with recessed face according to the present invention is substantially identical in construction to the dual insert face plate externally mounted to the front face of the basic embodiment of the putter head described above. Preferably, the thickness of the dual insert face plate for use in recessed face putter heads according to the present invention has a thickness substantially equal to the depth of the recess in the front face of the putter head body. With this construction, a selected outwardly facing face of the face plate is coplanar or flush with the adjacent front face surface of the putter head body, when the face plate is installed in the recess and seated on the rear or inner wall surface of the recess.

Preferably, the face plate of the recessed face putter head according to the present invention is secured within the recess in the front face of the putter head body by a pair of flat head socket screws which are inserted through a pair of countersunk holes provided through the face plate at laterally opposed sides of the inserts, the screws being tightened into a pair of aligned, threaded blind bores which extend into the rear, inner wall surface of the recess.

In one variation of a recessed-face dual-insert putter head according to the present invention, a pocket is cut inwardly or rearwardly of the rear or inner wall surface of the recess, the pocket being adapted to hold various combinations of weight members secured therein by suitable means, such as tightening the face plate against the front surfaces of the weight members and pressing them against the rear surface of the pocket. The weight members are used to alter static and/or kinematic characteristics of the club head. For example, a pair of laterally spaced apart, heel and toe weights may be secured within the pocket to thereby increase the moment of inertia of the putter head relative to its total weight.

In another variation of a recessed face putter head body according to the present invention, the front recess is cut deeper to accommodate a quadruple face plate which has a generally square, rather then rectangular cross-section, and which has four different inserts mounted in notches in the four faces of the face plate.

In another variation of a recessed face putter head according to the present invention, a small, centrally located symmetrically-shaped aperture is formed through the upper or crown wall of the putter head body, the aperture penetrating the face plate recess and thereby revealing through the aperture rear portions of a face plate installed in the recess, thereby assisting in providing a line of sight which a player may use to align the impact region of the putter face on the ball with an intended direction towards a hole.

DESCRIPTION OF THE PREFERRED EMBODIMENTS

FIGS. 1-6 illustrate various features of a basic, flat-face embodiment according to the present invention of a golf putter with a multiple striking surfaces, reversible face plate mounted on the front face of the putter head body.

FIGS. 7-26 illustrate various features of other embodiments of the invention in which a reversible face plate is mounted within a recess in the front face of the putter head body thereof.

Figures 1, 2, 3:
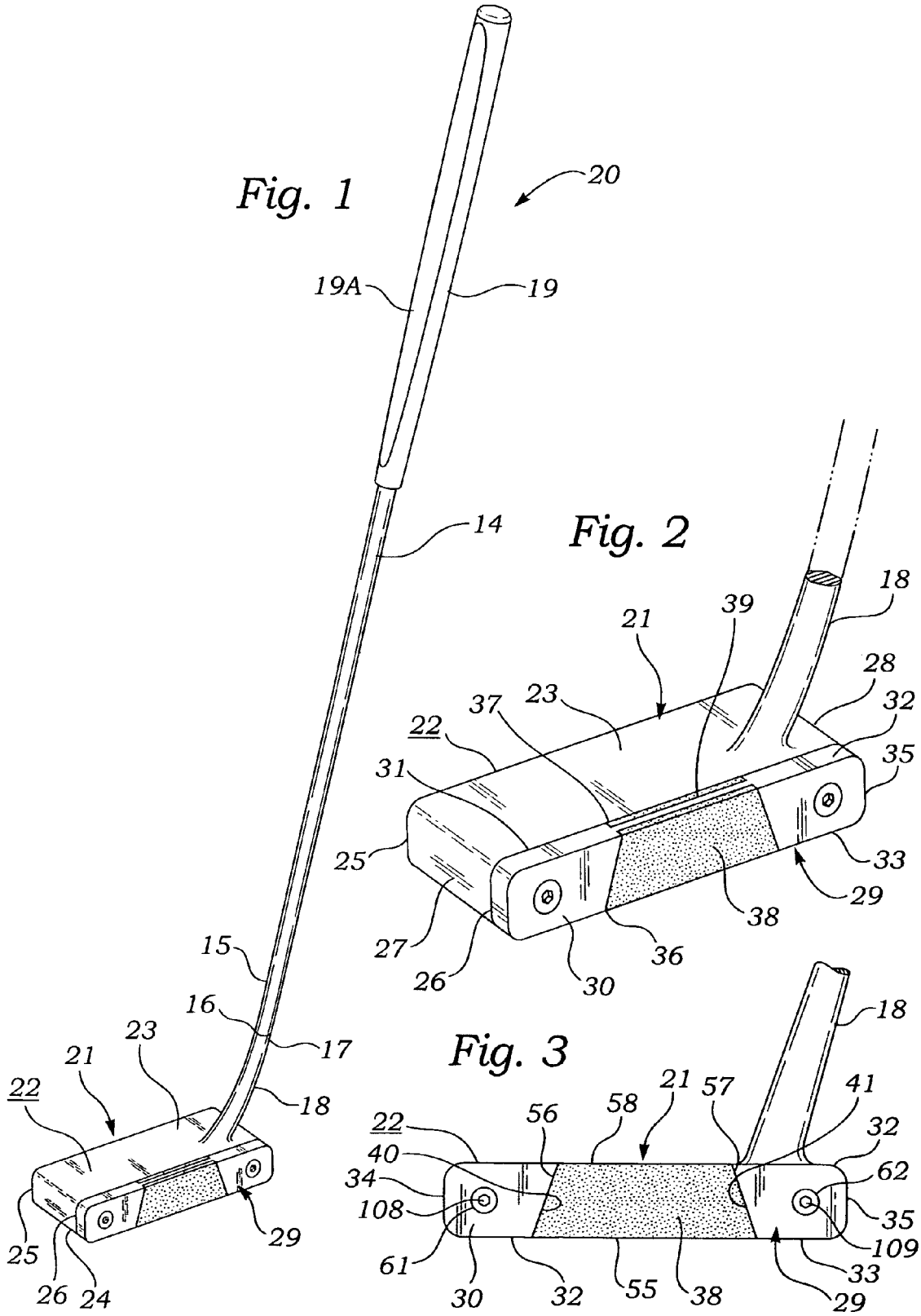
FIG. 1 is a front perspective view of a basic, flat-face embodiment of a golf putter with multiple striking-surfaces, reversible face plate according to the present invention.
FIG. 2 is a fragmentary upper perspective view of the putter of FIG. 1, showing a putter head thereof on an enlarged scale.
FIG. 3 is a front elevation view of the putter head of FIG. 2.

Referring first to FIGS. 1 and 2, a golf putter 20 with externally mounted, multiple striking surfaces, reversible face plate according to the present invention may be seen to include a head 21 comprising a laterally elongated, block-shaped body 22 which has an upper, generally flat, horizontally disposed surface or crown 23 and a generally horizontally disposed lower surface or sole 24 which optionally may have an arcuately curved, slightly convex shape. Putter 20 includes an elongated, generally straight shaft 14 which is terminated at a lower end portion 15 thereof by a tubular section 16 which has a bore 17 that insertably receives a hosel 18 which protrudes upwardly from crown 23 of putter head body 22. Shaft 14 is preferably made of a strong, light weight material such as tubular stainless steel or a composite material, and has an upper hand grip portion 19. Grip 19 is preferably made of a relatively softer, resilient material such as an elastomeric polymer or leather, which enables the grip to be firmly yet comfortably gripped with the hands of a golfer. Preferably, grip 19 has a generally oval cross-section, modified by a flat portion 19A on which the thumbs may be placed to define a plane in which the putter is swung to impact a golf ball. Putter head body 22 also has a rear surface 25 which has a generally vertically disposed, flat rectangular shape. However, rear surface 25 may have other various desired shapes, since the rear shape is not critically related to the purposes of the present invention. For example, although putters shown in the present disclosure have a generally block-like shape characteristic of a mallet-type putter, they could also have a blade-like shape. As shown in to FIGS. 1 and 2, putter head body 22 has a front face 26 which preferably is perpendicular to sole surface 24, but may be inclined at an angle slightly less than 90 degrees to the sole, the deviation from perpendicularity typically being a few degrees and designated as a loft angle.

As shown in FIG. 3, front face 26 of putter head body 22 preferably has a laterally symmetric shape, i.e., a shape which is symmetric with respect to a vertical fore-and-aft plane disposed through the front face wall and equidistant from side walls of the body. Thus, as shown in FIG. 3, putter head body 22 has left and right, toe and heel side surfaces 27, 28, respectively, which are disposed upwardly from opposite lateral sides of sole 24 at equal angles, e.g., ninety degrees. Optionally, the dihedral angles between both sole 24 and both toe and heel sides 27, 28, may be slightly less than ninety degrees with respect to the sole, thus resulting in the sides being inclined inwardly slightly towards the center plane of body 22, but the sides could also optionally diverge outwardly at angles greater than ninety degrees to the sole.

Figure 4:
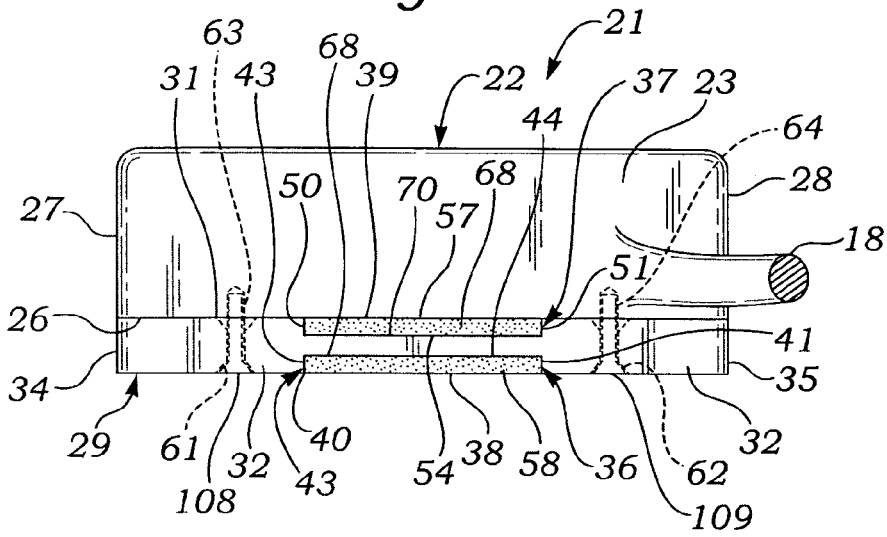
FIG. 4 is an upper plan view of the putter of FIG. 2.
Figure 5:
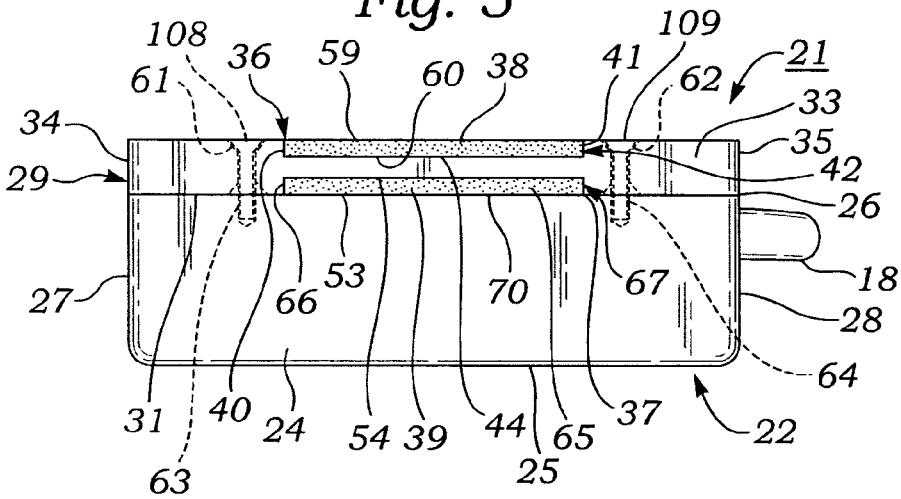
FIG. 5 is a lower plan view of the putter head of FIG. 2.

Referring now to FIGS. 4 and 5, in addition to FIGS. 1-3, it may be seen that putter head 21 has a thin face plate 29 of generally uniform thickness attached conformally and parallel to front face 26 of putter head body 22. As shown in FIGS. 2 and 3, face plate 29 has in front elevation view a shape generally congruent with front face 26 of body 22. Thus, face plate 29 has a flat front surface 30, a flat rear surface 31 parallel to the front surface, a straight upper edge 32, a lower edge 33 generally parallel to upper edge 32, and upwardly disposed toe and heel side surfaces 34, 35, respectively. As may be seen best by referring to FIGS. 2-4, face plate 29 preferably has formed in opposed front and rear surfaces or faces 30, 31 thereof an opposed pair of shallow, uniform cross-section notches 36, 37, respectively, in which are conformally mounted front and rear inserts 38, 39, respectively.

As shown in FIGS. 1-5, notch 36 in front face 30 of face plate 29 preferably extends perpendicularly inwards towards a center plane parallel to the thickness dimension of the face plate in which case the notch has a uniform transverse cross-section, although the cross-section may optionally be tapered. In the example embodiment shown in FIGS. 1-5, notch 36 has a trapezoidal or wedge shape, although the shape is not critical and could have other, e.g., polygonal shapes.

The trapezoidal notch 36 shown in FIGS. 2-5, has upwardly disposed, inwardly angled straight left and right edges or side walls 40, 41, respectively, which penetrate lower edge 33 of face plate 29, forming a thin, laterally elongated, rectangularly-shaped opening 42 in the lower edge. Side walls 40, 41 of notch 36 angle inwardly towards a vertical center line of the notch, and extend upwardly through upper edge 32 of face plate 29, and penetrate upper edge 32, thus forming a thin, laterally elongated rectangularly-shaped upper opening 43. Thus, as shown in FIGS. 2-5, left and right side walls 40, 41 of notch 36, in combination with those portions of upper edge 32 and lower edge 33 that are pierced by the notch, form a generally trapezoidal shape.

Notch 36 is adapted to conformally receive and retain therein a rebound control insert 38, which has selected ball-impacting characteristics, as will be described below. Notch has a flat inner wall surface 44 on which insert 38 is seated. In a preferred embodiment of putter 21 according to the present invention, notch 37 in rear face 31 of face plate 29 has a shape similar to that of notch 36 in front face 38. Thus, rear notch 37 has angled, straight left and right edges or side walls 50, 51, which penetrate upper and lower edges 32, 33 of face plate 29, to form lower and upper rectangularly-shaped openings 52, 53, the side walls being aligned in a fore-and-aft direction with side walls 40, 41 of front notch 36, and terminate in a flat inner wall surface 54 parallel to and spaced rearward of inner wall surface 44 of front notch 36.

Front insert 38 has a plan-view shape complementary to that of front notch 36. Thus, front insert 38 has a generally horizontally disposed lower base or edge wall 55, and straight left and right side walls 56, 57, which angle inwardly and extend upwardly to a straight, horizontally disposed upper edge wall 58. Front insert 38 has a generally flat front ball-impacting surface 59, and a generally flat rear surface 60 which preferably is parallel to the front surface. Front insert 38 is secured within front notch 36 by any convenient means, such as a thin layer of adhesive between rear surface 60 of the insert and inner wall surface 44 of the notch.

In a preferred embodiment, front insert 38 is fabricated from a thin sheet of polymeric material such as polyurethane which has controlled hardness, rebound and frictional characteristics. Also, front insert 38 preferably, has a uniform thickness which is substantially equal to the depth of front notch 36. With this construction, when front insert 38 is secured in front notch 36, outer surface 59 of insert 38 is substantially flush with front face 30 of face plate 29, as shown in FIGS. 4 and 5.

Rear insert 39 preferably has the same shape and dimensions as front insert 38. Thus, rear insert 39 has a generally horizontally disposed lower base or edge wall 65, and straight left and right side walls 66, 67 which angle inwardly and extend upwardly to a straight, horizontally disposed upper edge wall 68. Rear insert 39 has a generally flat outer ball-impacting surface 69, and a generally flat inner surface 70 which preferably is parallel to the outer surface. Rear insert 39 is secured within rear notch 37 by any convenient means, such as a thin layer of pressure sensitive adhesive between rear surface 70 of the insert and the inner wall surface 54 of the notch.

In a preferred embodiment, rear insert 39 is fabricated from a thin sheet of polymeric material such as polyurethane which has controlled hardness, rebound, and frictional characteristics, at least one of which differs from the corresponding characteristic of front insert 38. Preferably, rear insert 39 has a uniform thickness which is substantially equal to the depth of rear notch 37. With this construction, when rear insert 39 is secured in rear notch 37, outer surface 69 of insert 39 is substantially flush with rear face 31 of face plate 29.

FIGS. 1-6 illustrate a construction of golf putter head 21 which enables face plate 29 to be reversibly and interchangeably attached congruently to front face 26 of putter head body 22, with a selected one of either front insert 38 or rear insert 39 positioned in an outer facing, ball-impacting disposition. Thus, as shown in FIGS. 1-6, face plate 29 has formed perpendicularly through its thickness dimension a pair of countersunk through-holes 61, 62 located laterally outwardly from left and right side edge walls 40, 41 of front notch 36, and left and right side edge walls 50, 51 of rear notch 37. This construction also includes a pair of blind threaded bores 63, 64 which extend perpendicularly into front face 26 of putter head body, the blind bores being aligned with through-holes 61, 62 through face plate 29, when the face plate is congruently aligned with face 26 of the putter head body.

Face plate 29 is secured to face 26 of putter head body 22 with front insert 38 or rear insert 39 positioned in an outer, forward facing ball-impacting disposition by a pair of flat-head Allen or socket screws 108, 109 inserted into through-holes 61, 62 of the face plate and threadingly tightened into bores 63, 64 into the putter head body. The above-described construction enables face plate 29 to be fastened to putter head body 21 with either front insert 38 or rear insert 39 disposed in an outer, front-facing, ball-impacting position. When a player desires to configure putter 21 to have a different ball-impacting characteristic, such as for example a higher rebound factor for slow greens or a lower rebound factor for fast greens, face plate 29 is removable from putter head body 21, reversible and re-attachable to face 26 of the putter head body to position the insert 38 or 39 with the desired ball-impacting characteristic in a forward-facing, playing position.

Figure 6:
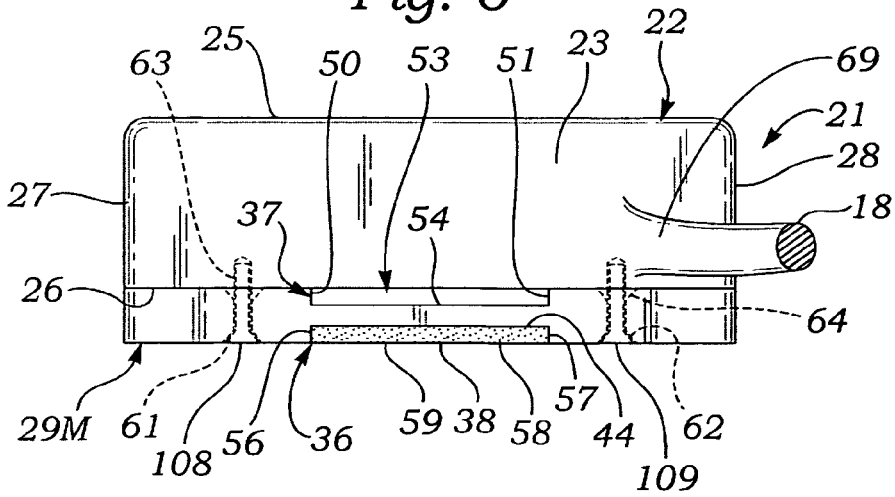
FIG. 6 is an upper plan view of the putter head of FIG. 3, fitted with a different type, non-reversible face plate.

FIG. 6 illustrates a modified face plate 29M for use with putter head body 22, which contains only one insert, e.g., a front insert 38, the other, rear notch 37 being empty. This construction enables the weight per unit area and flexural modulus of the face plate web between inner facing wall surfaces 44, 54 of front and rear notches 36, 37, respectively, to be somewhat less than that of a face plate provided with both front and rear inserts, and/or decreases the damping of vibrations induced in the face plate upon impacting a ball, thus resulting in a livelier tactile and/or audible response upon putting a ball, which is desired by some golfers. The loft angles of the front and rear faces of face plate may also optionally be varied.

FIGS. 7-12 illustrate a preferred embodiment of a golf putter with multiple striking surfaces, reversible face plate according to the present invention, in which a reversible face plate is mounted within a recess in the front face of a putter head body, rather than being attached externally to the front surface of a flat-faced putter head body.

Referring to FIGS. 7-12, a putter head 71 with an internally mounted reversible face plate having multiple striking surfaces according to the present invention may be seen to include a body 72 which has an exterior shape similar to that of the basic embodiment 21 of the putter head body described above. Thus, as shown in FIGS. 7-10, putter head body 72 has a generally laterally symmetrical, block-like shape which includes an upper, generally flat, horizontally disposed surface or crown 73, and a generally horizontally disposed lower surface or sole 74 which optionally has an arcuately curved, slightly convex shape. Putter head body 72 also has a rear surface 75 which may have various desired shapes, since the rear shape is not critically related to the purposes of the present invention.

Figure 7:
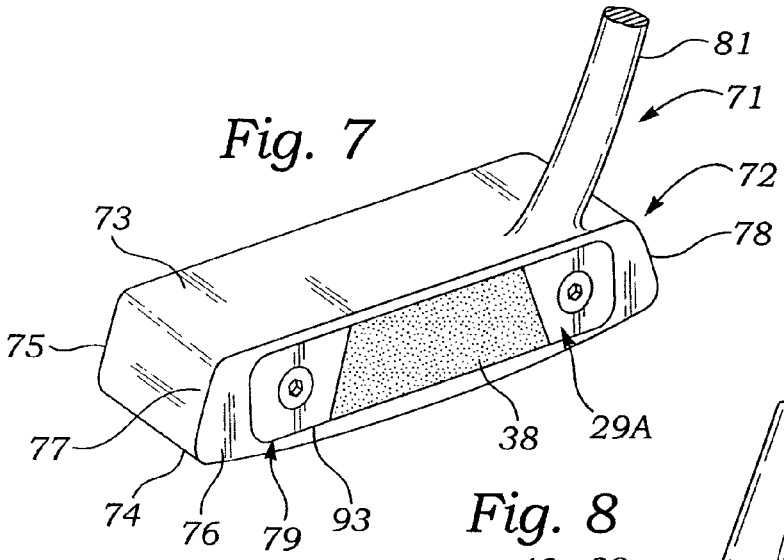
FIG. 7 is a front perspective view of a second, recessed face embodiment of a golf putter head with multiple striking-surfaces, reversible face plate according to the present invention.
Figure 9:
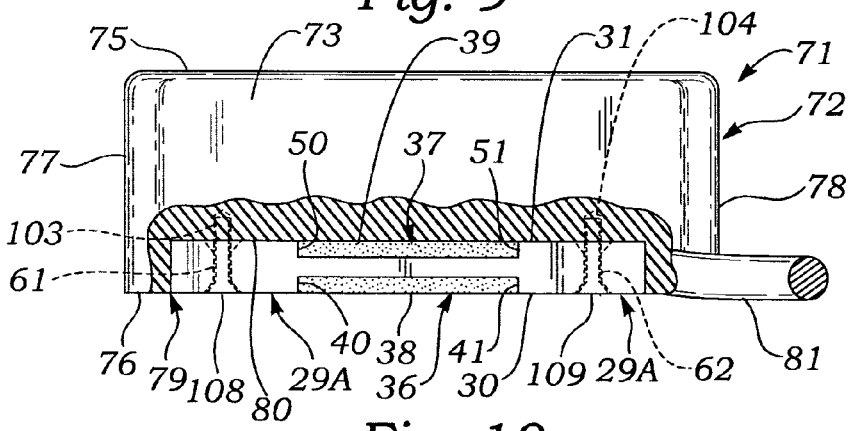
FIG. 9 is a broken-away upper plan view of the golf putter head of FIG. 7.
Figure 10:
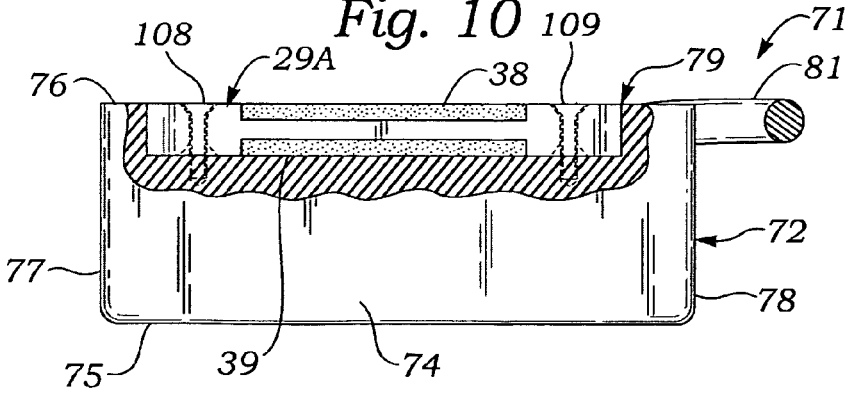
FIG. 10 is a broken-away lower plan view of the golf putter head of FIG. 7.

As shown in FIGS. 7 and 9, rear surface 75 of putter body 72 has a generally vertically disposed, flat trapezoidal shape, which, as stated above, is not critical to the function of the invention. Putter head body 72 also has a front face 76 which has an outline shape similar to that of rear face 75. As shown in FIGS. 9 and 10, front face 76 of putter head body 72 preferably is perpendicular to sole surface 74, but may be inclined at an angle slightly less than 90 degrees to the sole, the deviation from perpendicularity being a few degrees and typically designated as a loft angle.

Figure 8:
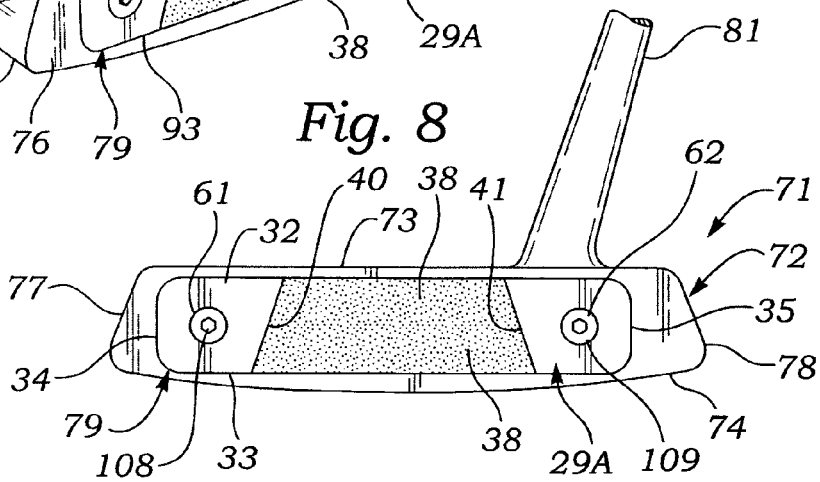
FIG. 8 is a front elevation view of the second embodiment of a golf putter head with multiple striking-surfaces, reversible face plate according to the present invention, shown in FIG. 7.

As shown in FIG. 8, putter head body 72 has left and right, toe and heel side surfaces 77, 78, respectively, which protrude upwardly from opposite lateral sides of sole 74, e.g., at slightly acute angles. However, the inclination angles of side surfaces 77, 78 to sole 74 are not critical to functions of the present invention, and may therefore optionally be right angles or obtuse angles.

Putter 71 includes a hosel 81 which protrudes upwardly from crown 73 of putter head body 72. In the embodiment shown in FIGS. 7 and 8, hosel 81 is offset towards and angled outwardly of heel side 78, but could be positioned and/or angled differently without affecting functions of the present invention.

Figure 11:
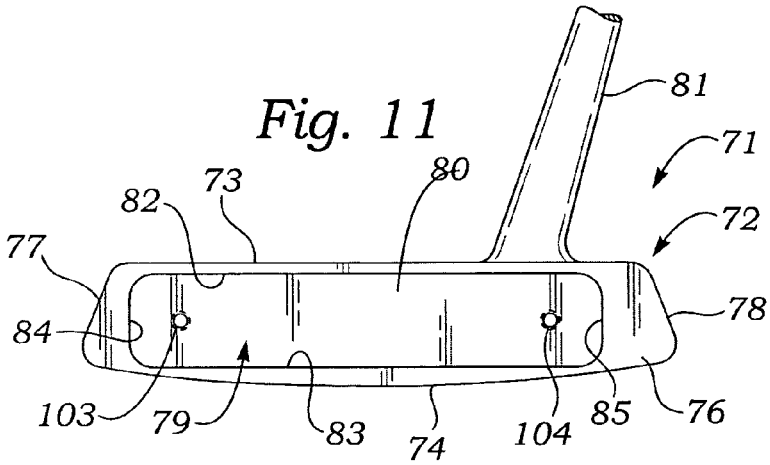
FIG. 11 is a fragmentary front elevation view of the golf putter head of FIG. 7, showing a dual insert face plate thereof detached from the body thereof, preparatory to reversing and re-attaching the face plate to the body.

As shown in FIGS. 7-11, putter head body 72 has formed in front face 76 thereof a laterally elongated, rectangularly-shaped recess or well 79 which is centered within the outline shape of the face and which extends perpendicularly inwardly from the face into the body. As may be seen best by referring to FIG. 11, recess 79 preferably extends perpendicularly inwardly from outer, front face 76 of putter head body 72 to an inner planar base wall 80 which is parallel to outer face 76. In this case, as shown in FIGS. 9, 10 and 11, recess 79 has a uniform transverse cross-section. Recess 79 has a straight, flat upper edge wall 82, a straight, flat lower edge wall 83 parallel to the upper edge wall, a straight, flat left, toe side edge wall 84 perpendicular to the upper and lower edge walls, and a straight, flat right, heel edge wall 85 parallel to the toe edge wall.

Figure 12:
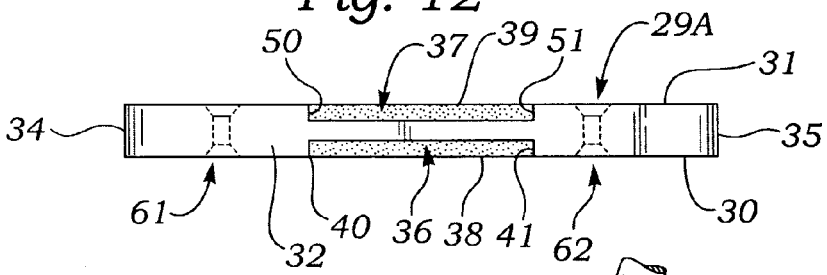
FIG. 12 is an upper plan view of a two-sided, dual striking surface, reversible face plate of the golf putter head of FIG. 7.

Recess 79 in front face 76 of golf putter head body 72 is adapted to conformally receive and retain therein an internal face plate 29A which has a construction substantially identical to that of external face plate 29 described above, but may be of a different size. As shown in FIGS. 8, 11 and 12, recess 79 has a laterally elongated, rectangular shape similar to, but slightly larger than face plate 29A. Thus, as shown in FIGS. 8, 11 and 12, face plate 29A has a front flat surface 30, a rear flat surface 31 parallel to the front surface, a straight upper edge 32, a straight lower edge 33 parallel to the upper edge, a straight left edge 34 perpendicular to the upper and lower edges, and a straight right edge 35 parallel to the left edge. Recess 79, which has a shape complementary to that of face plate 29A, has in addition to rear base wall 80 upper, lower, left and right edge walls 82, 83, 84, 85 which are similarly positioned but relatively slightly larger than corresponding sides 32, 33, 34, 35 of face plate 29A.

As shown in FIGS. 9 and 10, the thickness of face plate 29A is equal to or slightly less than the depth of recess 79. With this construction, when face plate 29A is inserted conformally into recess 79, outer surface 90 of face plate 29A is substantially flush with outer, front face 76 of putter head body 72.

Putter head 71 is so constructed as to enable face plate 29A to be mounted within recess 79 with a selected one of either front insert 38 or a rear insert 39 of the face plate positioned in an outer-facing, ball-impacting disposition. Thus, as shown in FIGS. 7-10, face plate 29A has formed perpendicularly through its thickness dimension a pair of countersunk through-holes 61, 62, located laterally outwardly from left and right side edge walls 40, 41 of front notch 36 of insert 38, and left and rear side walls 50, 51 of rear insert notch 37. This construction also includes a pair of blind threaded bores 103, 104 which extend perpendicularly into rear, inner base wall 80 of recess 79 in putter head body 72, the blind bores being aligned with through-holes 61, 62 through face plate 29A, when the face plate is inserted conformally into the recess.

Face plate 29A is secured within face 76 of putter head body 72 with front insert 38 or rear insert 39 positioned in an outer, forward facing ball-impacting disposition by a pair of flat-head Allen or socket screws 108, 109 inserted into through-holes 61, 62 of the face plate and threadingly tightened into bores 103, 104 into the putter head body. The above-described construction enables face plate 29A to be fastened to putter head body 72 with either front insert 38 or rear insert 39 disposed in an outer, front-facing, ball-impacting position. When a player desires to configure putter 71 to have a different ball-impacting characteristic, such as for example a higher rebound factor for slow greens or a lower rebound factor for fast greens, face plate 29A is removable from putter head body 72, reversible and insertable into recess 79 in face 76 of the putter head body to position the selected insert 38 or 39 with the desired ball-impacting characteristics in a forward-facing, playing position.

Figure 13:
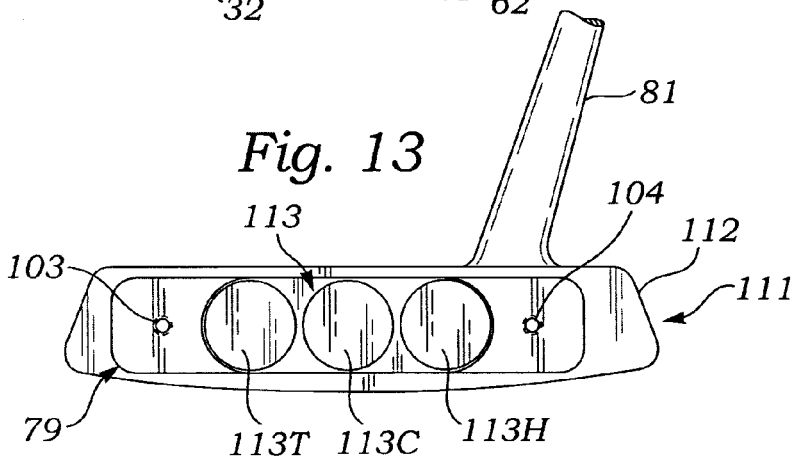
FIG. 13 is a fragmentary front elevation view of a first modification of the golf putter head of FIG. 8, which is provided with a weight pocket located inwards of a face-plate recess thereof.
Figure 14:
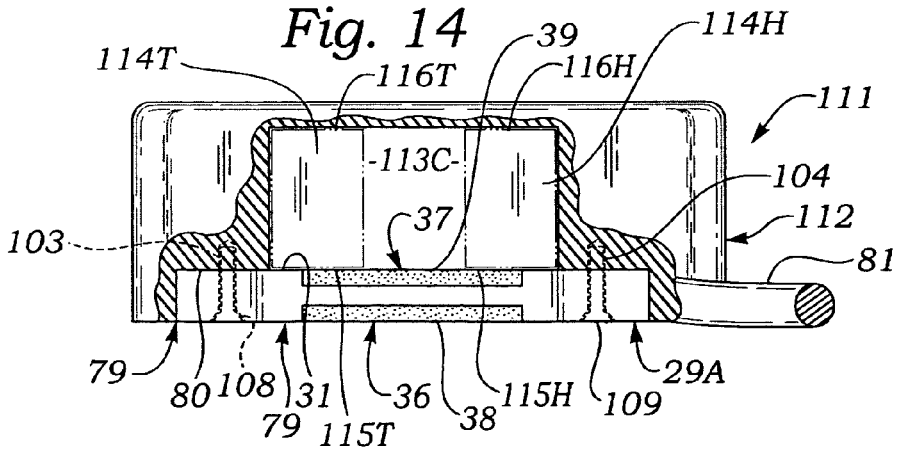
FIG. 14 is a broken away upper plan view of the modified putter head of FIG. 13, showing two weights installed in the weight pocket and retained in the pocket by attachment of a face plate to the putter head body.

FIGS. 13 and 14 illustrate a first modification 111 of putter head 71, which includes a weight pocket located inwards of a face plate recess in the putter head body. As shown in FIGS. 13 and 14, body 112 of putter head body 111 has formed therein a laterally elongated pocket 113 which extends inwardly or rearwardly from inner base wall 80 of recess 79, the construction of which is identical to that of putter 71 described above. Preferably, pocket 113 has a uniform transverse cross section. Although pocket 113 may have a polygonal shape, the pocket may be segmented into adjacent compartments. Thus, as shown in FIG. 13, pocket 113 is formed of three laterally adjacent, generally cylindrically-shaped toe, center and heel compartments 113T, 113C, 113H, respectively.

As shown in FIGS. 13 and 14, weight compartments 113T, 113C, 113H are adapted to hold cylindrically-shaped weights, such as a toe weight 114T and a heel weight 114H. Weights 114T, 114H have front and rear planar surfaces 115T, 115H, 116T, 116H, respectively and are slightly longer than the depth of pockets 113. Thus, when face plate 89 is seated on base wall 84 by tightening screws 108, 109 into threaded bores 103, 104 in body 112, weights 114T, 114H are pressed between rear surface 31 of the face plate and inner wall surface 117 of pockets 113.

The configuration of putter head body 112 shown in FIG. 14, in which toe and heel weights are held within the putter head body, increase the moment of inertia of the putter head, relative to its total weight. Of course, other arrangements of weights are possible, such as a single weight positioned in either a toe or heel compartment to increase toe or heel weights, respectively, or in all three compartments to increase the overall weight of the club head.

Figure 15:
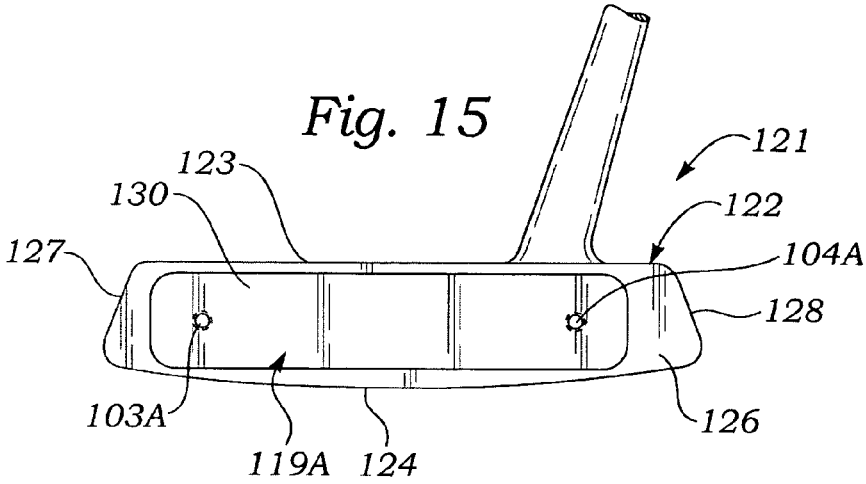
FIG. 15 is a front elevation view of a second modification of the golf putter head of FIGS. 8 and 9, which is provided with a deeper face plate recess than that of the head shown in FIG. 9.
Figure 16:
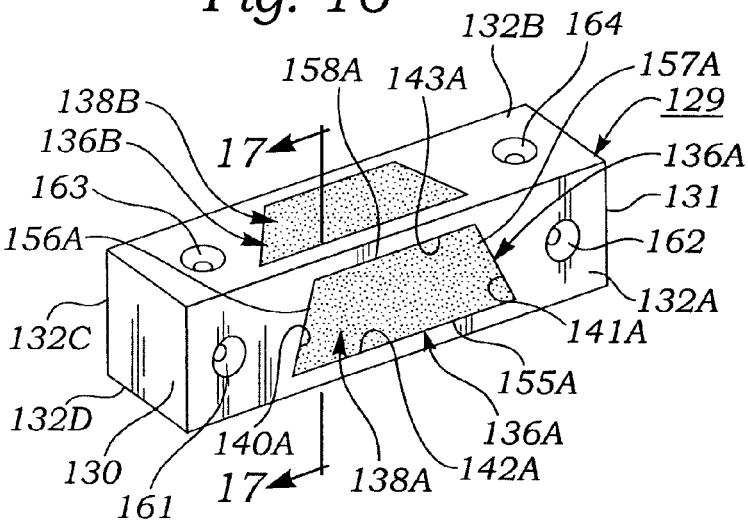
FIG. 16 is a perspective view of a quadruple insert, reversible face plate provided with four different striking surfaces, for use with the putter head of FIG. 15.
Figure 17:
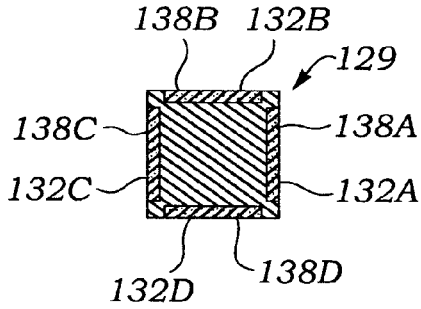
FIG. 17 is a vertical transverse sectional view of the quadruple-insert reversible face plate of FIG. 16.
Figure 18:
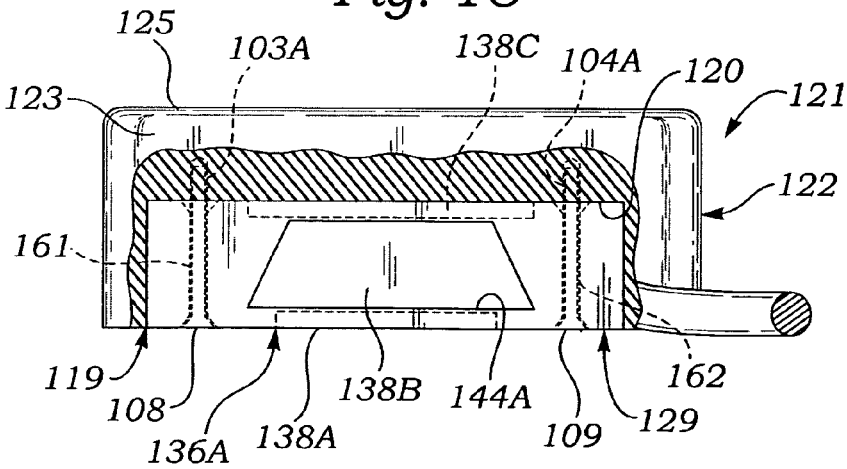
FIG. 18 is a broken away upper plan view of the putter head of FIG. 15, showing the quadruple insert face plate of FIG. 16 installed in the head.

FIGS. 15-18 illustrate a modification 121 of putter head 71 described above. Modified putter head 121 is substantially identical to putter head 71, except for being provided with recess 119A in front face 116 thereof which is approximately twice as deep as recess 79 in putter head 71. Thus, as shown in FIGS. 16-18, recess 119A is adapted to hold conformally therewithin a square cross-section face bar 129 which is approximately twice as thick as face plate 29 or 29A described above.

As shown in FIGS. 16 and 17, face bar 129 has the shape of a laterally elongated, square cross-section parallelepiped or block which has square left and right, fore-and-aft disposed toe and heel transverse end faces 130, 131, respectively. Face bar 129 also has four laterally elongated, rectangularly-shaped lateral faces 132A, 132B, 132C and 132D which are perpendicularly disposed between transverse end faces 130, 131. Lateral faces 132A, 132B, 132C, 132D each has formed therein a shallow, uniform transverse cross-section notch 136A, 136B, 136C, 136D, respectively, each of which has a polygonal, e.g., trapezoidal shape. As shown in FIG. 16, each notch, e.g., notch 136A has upwardly disposed, inwardly angled straight left and right edges or side walls 140A, 141A and laterally disposed lower and upper edge walls 142A, 143A, respectively. Also, each notch, e.g., notch 136A, is adapted to conformally receive and retain therein a rebound control insert 138A which has selected ball-impacting characteristics, as described above for inserts 38 and 39. Thus, insert 138A has a trapezoidal plan-view shape complementary to that of notch 136A, including a generally horizontally disposed lower base or edge wall 155A, and straight left and right side edge walls 156A, 157A, which angle inwardly and extend upwardly to a straight, horizontally disposed upper edge wall 158A. Each insert, e.g., insert 138A, has a generally flat front ball-impacting surface 159A, and a generally flat rear surface 160A which preferably is parallel to the front surface. Insert 138A is secured within notch 136A by any convenient means, such as a thin layer of adhesive between rear surface 160A of the insert and inner wall surface 144A of the notch.

As shown in FIG. 16, each notch and the insert mounted therein, e.g., notch 136A and insert 138A, is laterally and vertically centered within the face, e.g., 132A, in which it is positioned. As shown in FIG. 16, face bar 129 is so constructed as to enable the face bar to be mounted within recess 119A in front face 126 of putter head body 122, with a selected one of the four inserts 138A, 138B, 138C, 138D positioned in an outer-facing, ball-impacting disposition. Thus, as shown in FIG. 16, face bar 129 has formed perpendicularly through a first pair of parallel opposed lateral faces 132A, 132C thereof a first pair of through-holes 161, 162 which extend perpendicularly through the face bar. Through-holes 161, 162, which are countersunk at both ends, are located laterally outwardly from left and right side edge walls 140A, 141A of front notch 136A and front insert 138A, and left and right side edge walls 140C, 141C of opposed, rear notch 136C and rear insert 138C. Face bar 129 also has formed perpendicularly through a second pair of parallel lateral faces which are perpendicular to the first pair a second pair of through-holes 163, 164 positioned, shaped and sized similarly to the first pair of holes 161, 162.

As shown in FIG. 18, putter head body 112 has formed in rear, inner base wall 120 of deep recess 119A in front face 116 of the putter head body a pair of blind threaded bores 103A, 104A, the blind bores being aligned with through holes 161, 162, or 163, 164, through face bar 129, when the face bar is inserted conformally into the recess.

Face bar 129 is secured within face 126 of putter head body 122 with insert 138A, 138B, 138C, or 138D positioned in an outer, forward-facing ball-impacting disposition by a pair of flathead Allen or socket screws 108, 109 inserted through through-hole pairs 161, 162, or 163, 164, and threadingly tightened into bores 103A, 104A within putter head body. The above-described construction enables face bar 129 to be installed in putter head body 112 with any of inserts 138A, 138B, 138C, or 138D disposed in an outer front-facing, ball-impacting position. When a player desires to configure putter head 111 to have different ball-impacting characteristics, such as a different rebound factor, hardness or ball-contact friction, screws 108, 109 may be unscrewed from bores 103A, 104A in putter head body 122, face bar 129 withdrawn from recess 119A, rotated about its long axis one, two or three quarter-turns, re-inserted into the recess with a desired insert 138 in a forward-facing use position, and screws 108, 109 re-installed to secure the face bar within putter head body 122.

Figure 19:
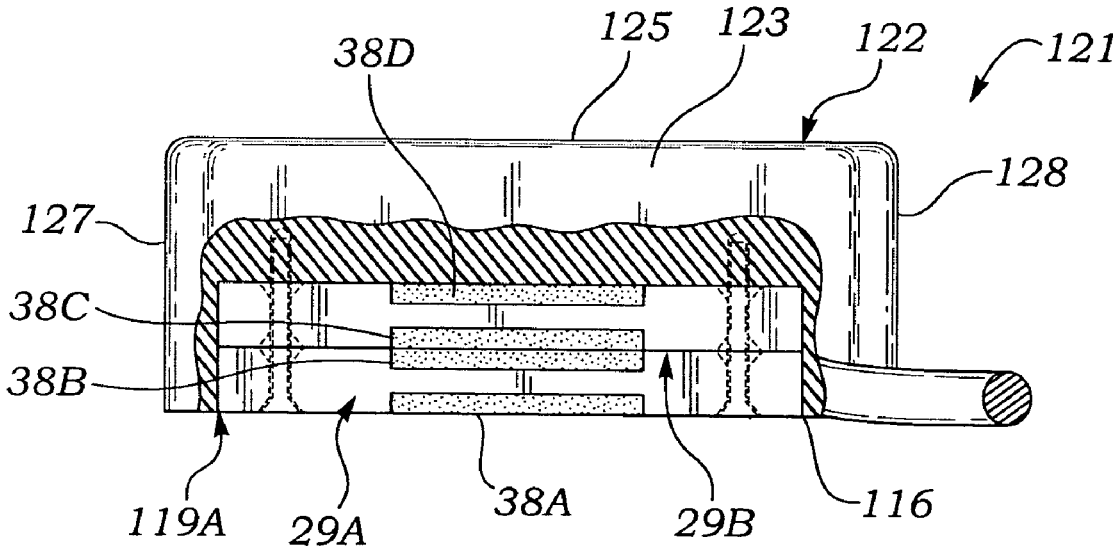
FIG. 19 is a broken away upper plan view of the putter head of FIG. 13, showing two double-insert face plates of the type shown in FIG. 12 installed in tandem in the head.

FIG. 19 illustrates an alternate configuration of putter 121, in which two double-insert face plates 29A, 29B of the type described above are secured within recess 119A of putter head body 122. Face plates 29B, 29B are identical in construction to face plate 29A descried above, except that the inserts 38A, 38B in one face plate 29A and inserts 38C, 38D in face plate 29B, each have different ball-impacting characteristics, each of which may be positioned in a forward-facing, ball-impacting position.

Figure 20:
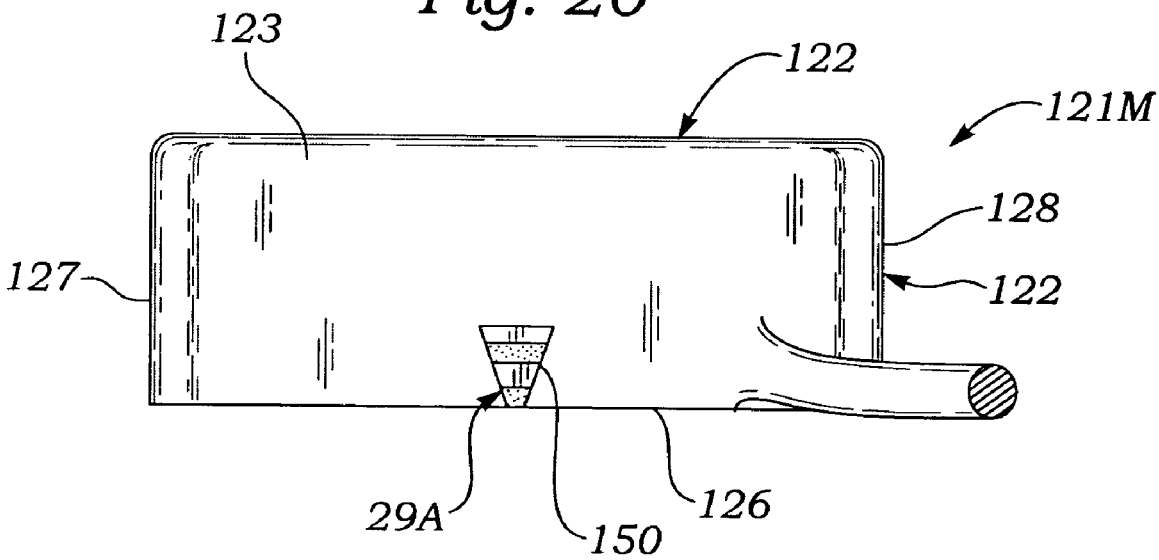
FIG. 20 is an upper plan view of a modification of the putter head of FIG. 15, in which an upper, crown wall thereof is provided with an sighting aperture through which an upper portion of a face plate installed in the head is viewable.

FIG. 20 illustrates a modification of putter 121 described above. Modified putter 121M has formed through crown 123 thereof an aperture 150 which communicates with recess 119A. Aperture 150 is preferably located equidistant between left and right side walls 127, 128 of putter head body 122, is located near front face 126, and preferably has a symmetrical shape. This arrangement enables the upper edges of a face bar 129 or pair of face plates 29A, 29B installed in recess 119A to be viewed through aperture 150, thereby assisting in providing a line of sight which a player may use to align the impact region of the insert in the putter face on the ball with an intended direction towards a hole. Optionally, an aiming aperture similar to aperture 150 may be formed through crown wall 73 of putter 71 described above.

FIGS. 21-26 illustrate another modification of the putter head of FIG. 15, in which a quadruple reversible face bar thereof is secured within the putter head body by a pair of laterally opposed, axially aligned side-mounted screws.

Figure 21:
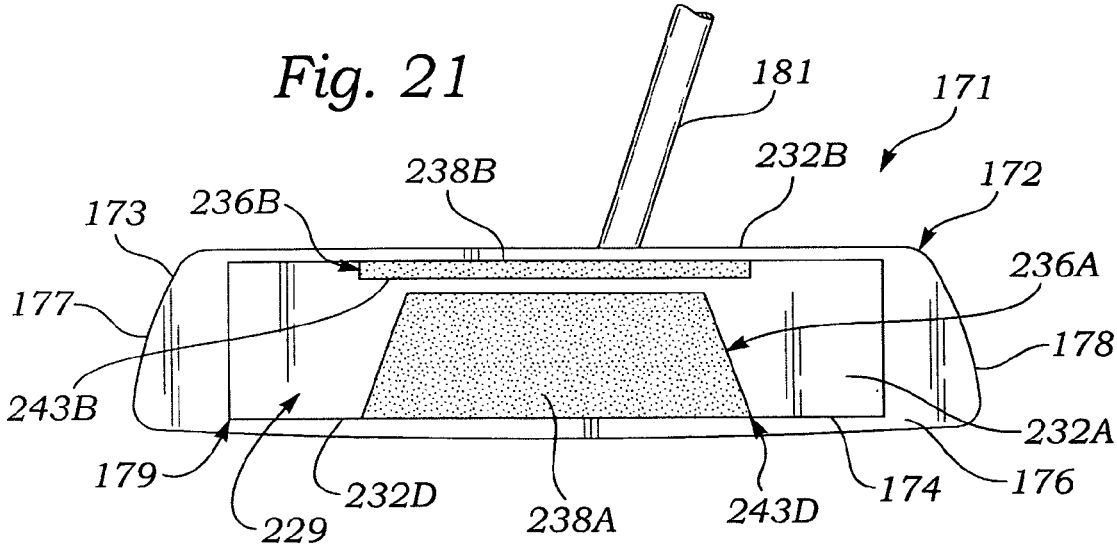
FIG. 21 is a front elevation view of another modification of the putter head of FIG. 15, in which a reversible face bar thereof is secured within the putter head body by a pair of laterally opposed, axially aligned side screws.
Figure 22:
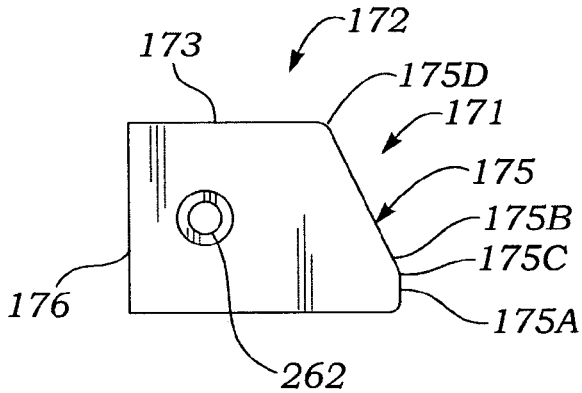
FIG. 22 is a left side elevation view of the putter head of FIG. 21.
Figure 23:
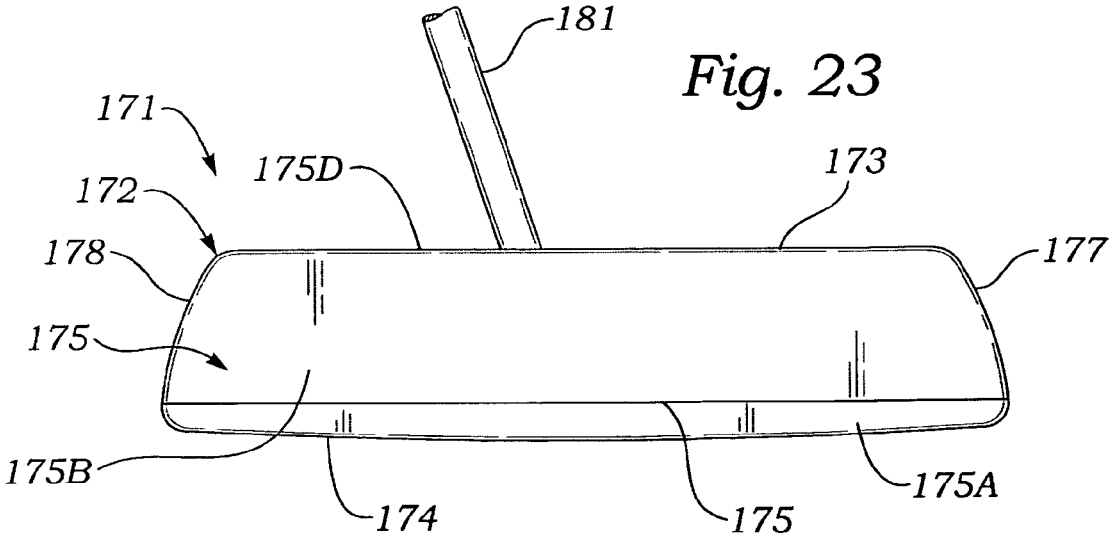
FIG. 23 is a rear elevation view of the putter head of FIG. 21.

As shown in FIG. 21, modified putter head 171 has in front elevation view a shape similar to quadruple face bar putter head 71 shown in FIGS. 15-18 and described above. Thus, putter head 171 has a body 172 which has a generally laterally symmetrical, block-shape body that includes an upper, generally flat, horizontally disposed surface or crown 173, and a generally horizontally disposed lower surface or sole 174 which optionally has an arcuately curved, slightly convex shape. Putter head body 172 also has a rear surface 175 which may have various shapes, since the rear shape is not critically related to the purposes of the present invention. In an embodiment of putter head body 172 depicted in FIGS. 22 and 23, rear surface 175 of the putter head body has a thin, laterally elongated generally vertically disposed rib section 175A which depends upwardly from sole 174, and a trapezoidally-shaped, generally flat rear face 175B which angles upwardly and forwardly from an upper horizontally disposed edge 175C of the rib section, the rear face having an upper horizontal edge 175D which intersects crown 173. Putter head body 172 also has a front face 176 which has an outline shape similar to that of rear trapezoidal face 175B. As shown in FIGS. 21 and 22, front face 176 of putter head body 172 preferably is perpendicular to sole surface 174, but may be inclined at an angle slightly less than 90 degrees to the sole, the deviation from perpendicularity being a few degrees and typically designated as a loft angle.

As shown in FIG. 21, putter head body 172 has left and right, toe and heel side surfaces 177, 178, respectively, which protrude upwardly from opposite lateral sides of sole 174. Although the dihedral angles between side surfaces 177, 178 and sole 174 are not critical to functions of the present invention, in the embodiment of putter head 177 shown in FIG. 21, the side surfaces angle upwardly and inwardly towards crown 173, thus making slightly acute angles with sole 174.

Putter head 171 includes a hosel 181 which protrudes upwardly from crown 173 of putter head body 172. In an embodiment shown in FIGS. 21 and 23, hosel 181 is offset towards and angled outwardly of heel side 178, but could be positioned and/or angled differently without affecting functions of the present invention.

Figure 24:
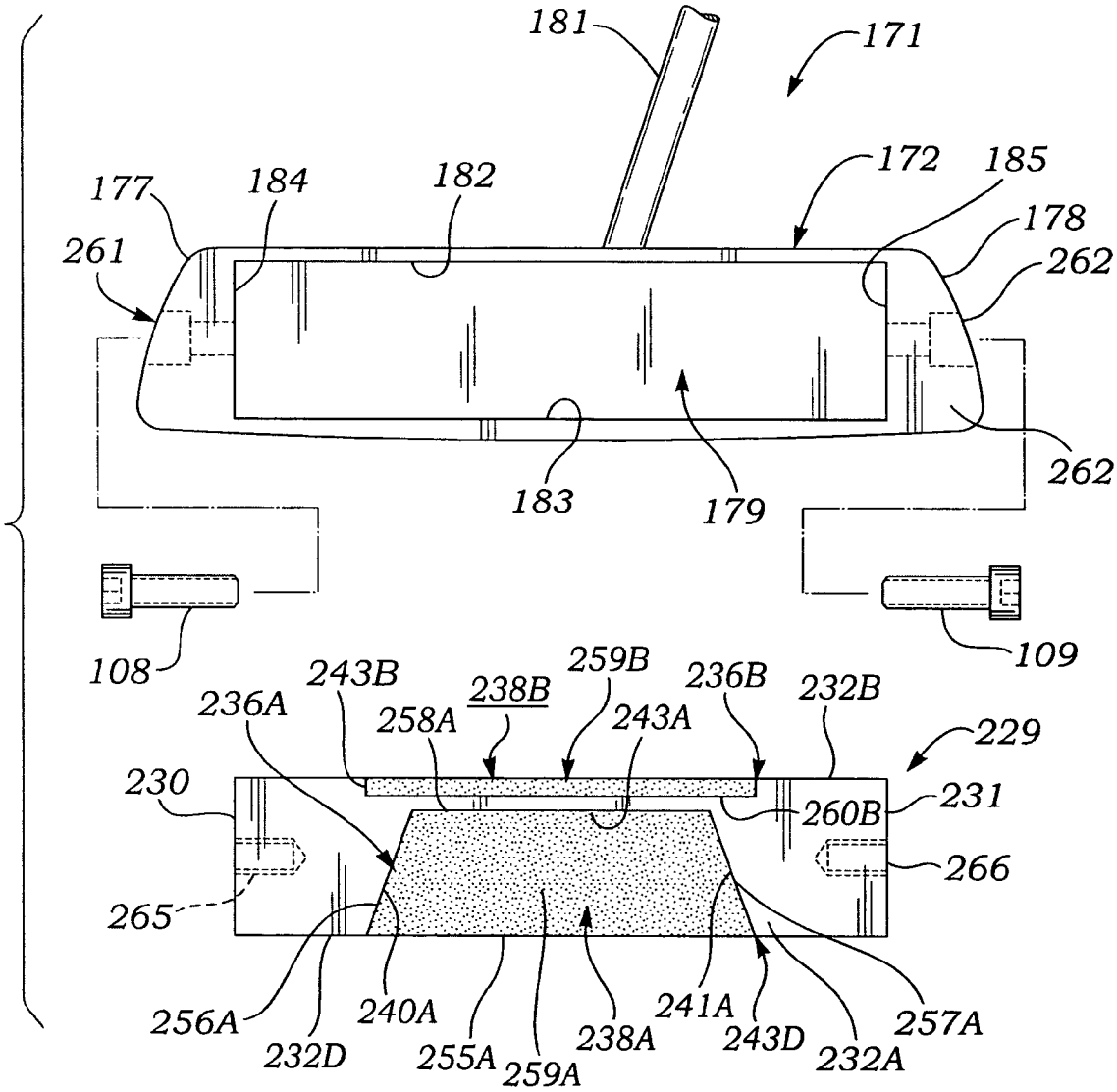
FIG. 24 is an exploded front elevation view of the putter head of FIG. 21, showing securing screws and a face bar thereof removed.
Figure 26:
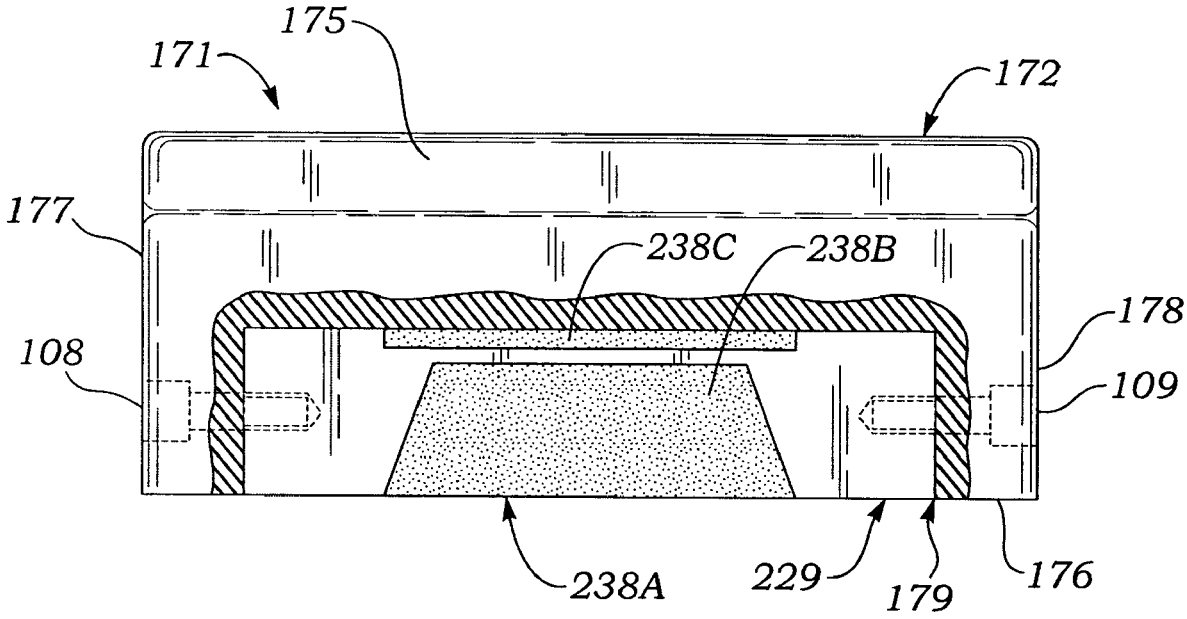
FIG. 26 is a broken-away upper plan view of the putter head of FIG. 21.

As may be seen best by referring to FIGS. 24 and 26, putter head body 172 has formed in front face 176 thereof a laterally elongated, rectangularity-shaped recess or well 179 which is centered within the outline shape of the face, i.e., concentric with the perimeter of face 176, and which extends perpendicularly inwardly or rearwardly from the face into the body. As may be seen best by referring to FIGS. 24 and 26, recess 179 preferably extends perpendicularly inwardly from outer, front face 176 of putter head body 172 to an inner planar base wall 180 which is parallel to outer face 176. In this case, as shown in FIGS. 24 and 26, recess 179 has a straight, flat upper edge wall 182, a straight, flat lower edge wall 183 parallel to the upper edge wall, a straight, flat left or toe side edge wall 184 perpendicular to the upper and lower edge walls, and a straight, flat right or heel edge wall 185 parallel to the toe edge wall.

Recess 179 in front face 176 of golf putter head body 172 is adapted to conformally receive and retain therein an internal quadruple-insert face bar 229 which is substantially similar in construction to quadruple insert face bar 129 which was described above. As may be seen best by referring to FIGS. 24-26, face bar 229 has the shape of a laterally elongated, square cross-section parallepiped or block which has square left and right, fore-and-aft disposed toe and heel transverse end faces 230, 231, respectively. Face bar 229 also has four laterally elongated rectangularly-shaped lateral faces 232A, 232B, 232C and 232C which are perpendicularly disposed between transverse and faces 230, 231. Lateral faces 232A, 232B, 232C, 232D each has formed therein a shallow, uniform transverse cross-section notch 236A, 236B, 236C, 236D, respectively, each of which has a polygonal, e.g., trapezoidal shape. As shown in FIG. 24, each notch, e.g., notch 236A, has straight left and right edges or side walls 240A, 241A which are angled inwardly and upwardly towards a vertical center line of face bar 229. Also, each notch, e.g., notch 236A has a laterally disposed upper edge wall 243A in face 232A in which it is formed, and penetrates a perpendicularly disposed adjacent face, e.g., 232D to form therein a laterally elongated, rectangularly-shaped opening 243D.

Each notch, e.g., notch 236A, is adapted to conformally receive and retain therein a rebound control insert 238A which has selected ball-impacting characteristics, as described above for inserts 38 and 39. Thus, insert 238A has a trapezoidal plan-view shape complementary to that of notch 236A, including a generally horizontally disposed base or edge wall 255A, and straight left and right side edge walls 256A, 257A, which angle inwardly and extend upwardly to a straight, horizontally disposed upper edge wall 258A. Each insert, e.g., insert 238A, has a generally flat front ball-impacting surface 259A and a generally flat rear surface 260A which preferably is parallel to the front surface. Insert 238A is secured within notch 236A by any convenient means, such as a thin layer of adhesive between rear surface 260A and inner wall surface 244A of the notch.

As shown in FIG. 24, each notch and the insert mounted therein, e.g., notch 236A and insert 238A, is laterally and vertically centered within the face, e.g., 232A, in which it is positioned.

Figure 25:
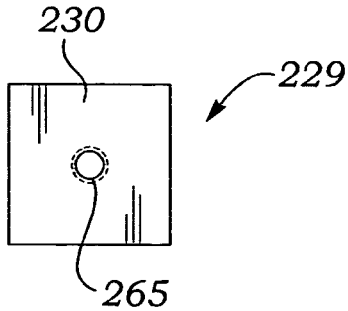
FIG. 25 is a side elevation view of the reversible face bar of FIG. 24.

As shown in FIGS. 24-26, face bar 229 is so constructed as to enable the face bar to be mounted within recess 229 in font face 226 of putter head body 222 with a selected one of the four inserts 238A, 238B, 238C, 238D positioned in an outer-facing, ball-impacting disposition. Thus, as shown in FIGS. 24-26, face bar 229 has formed in transverse end faces 230, 231 thereof a pair of blind threaded holes 265, 266, respectively, which extend perpendicularly into the face bar, the holes being centered in the end faces.

As is also shown in FIGS. 24-26, putter head body 172 has formed in toe and heel side walls 177, 178 thereof a pair of countersunk through-holes 261, 262 which penetrate left and right toe and heel walls 184, 185 of recess 179. Through-holes 261, 262 are axially aligned with threaded holes 265, 266 of face bar 229, with the face bar installed in recess 179. Face bar 229 is secured within face 226 of putter head body 222 with insert 238A, 238B, 238C or 238D positioned in an outer, forward-facing ball-impacting disposition by a pair of flat-head Allen or socket screws 108, 109 inserted through through-holes 261, 262, respectively, and threadingly tightened into bores 265, 266 in opposite end faces 230 to 231 of face bar 229. The above-described construction enables face bar 229 to be installed in putter head body 222 with any of the inserts 238A, 238B, 238C or 238D disposed in an outer front-facing ball-impacting position. When a player desires to configure putter head 211 to have different ball-impacting characteristics, such as a different rebound factor, hardness or ball-contact friction, screws 108, 109 may be unscrewed from bores 265, 266 in face bar 229, the face bar withdrawn from recess 179, rotated about its long axis one, two, or three-quarter turns, re-inserted into the recess with a desired insert 238 in a forward-facing use position, and screws 108, 109 re-installed to secure the face bar within putter head body 222.

What is claimed is:

1. A golf putter head for attachment to an elongated shaft provided with a handle grip to thereby constitute a golf putter, said putter head comprising;

a. a body which has a lower sole surface, an upper, crown surface spaced above said sole surface, laterally spaced apart toe and heel side surfaces disposed between said sole and crown surfaces, a rear surface disposed between said sole and crown surfaces, and a front face surface disposed between said sole and crown surfaces, b. at least a first rotatably reversible face plate having at least first and second ball-impacting faces which have therein first and second notches, respectively, said first and second notches holding therewithin first and second inserts, respectively, having different ball-impacting characteristics, said ball impacting faces being disposed parallel to a longitudinal axis of said face plate, said face plate being rotatable about said longitudinal axis to interchangeably position a selected one of said ball-impacting faces in a forward-facing, ball-impacting orientation, and c. a releasable fastener structure which enables said face plate to be removably and reversibly attached to said face of said body with a selected one of said ball-impacting faces of said face plate positioned in a forward-facing, ball-impacting orientation and the other of said ball-impacting faces positioned in a non-forward-facing, non-ball-impacting orientation.

2. The golf putter head of claim 1 wherein at least one of said ball-impacting faces of said face plate has a different loft angle than another of said ball-impacting faces.

3. The golf putter head of claim 1 wherein at least one of said different ball-impacting characteristics includes hardness.

4. The golf putter head of claim 1 wherein at least one of said different ball-impacting characteristics includes in combination with said body of said head a composite rebound factor which imparts to a ball impacted by said face at a particular swing velocity a particular momentum.

5. The golf putter head of claim 1 wherein at least one of different ball-impacting characteristics includes coefficient of friction between a golf ball and said insert.

6. The golf putter head of claim 1 further including at least a second face plate attachable to said body interchangeably with said first face plate.

7. The golf putter head of claim 6 wherein ball-impacting regions of said first and said faces of said second face plate have weights per unit area which differ from one another.

8. The golf putter head of claim 7 wherein said second face plate has at least one cavity formed in at least one of said first and second faces thereof.

9. The golf putter head of claim 1 wherein said releasable fastener structure is further defined as comprising in combination at least one screw, at least one hole through one of said face plate and said body, and at least one threaded bore in the other of said face plate and said body, whereby said screw is insertable through said hole and screwable into said threaded bore to thereby secure said plate from movement relative to said body.

10. A golf putter head for attachment to an elongated shaft provided with a handle grip to thereby constitute a golf putter, said golf putter head comprising;

a. a body which has a lower sole surface, an upper, crown surface spaced above said sole surface, laterally spaced apart toe and heel side surfaces disposed between said sold and crown surfaces, and a front body face disposed between said sole and crown surfaces, said front body face surface having formed therein a recess, b. at least a first rotatably reversible face plate having at least first and second ball-impacting faces which have therein first and second notches, respectively, said first and second notches holding therewithin first and second inserts, respectively, having different ball-impacting characteristics, said ball impacting faces being disposed parallel to a longitudinal axis of said face plate, said face plate being rotatable about said longitudinal axis to interchangeably position a selected one of said ball-impacting faces in a forward-facing ball-impacting orientation, said face plate having a size and shape which adapts said face plate to fit within said recess, and c. a releasable fastener structure which enables said face plate to be removably and reversibly secured within said recess in said body face with a selected one of said ball-impacting faces of said face plate positioned in a forward-facing ball-impacting orientation and the other of said ball-impacting faces positioned in a non-forward-facing, non-ball-impacting orientation.

11. The golf putter head of claim 10 wherein said face plate has a thickness measured between said first and second ball-impacting surfaces which is approximately equal to the depth of said recess, whereby when said face plate is secured within said recess a said selected ball-impacting face of said face plate is substantially flush with said body face of said body.

12. The golf putter head of claim 10 wherein at least one of said ball-impacting faces of said face plate has a different loft angle than another of said ball-impacting faces.

13. The golf putter head of claim 10 wherein at least one of said different ball-impacting characteristics includes hardness.

14. The golf putter head of claim 10 wherein at least one of said different ball-impacting characteristics includes in combination with said body of said head a composite rebound factor which imparts to a ball impacted by said face at a particular swing velocity a particular momentum.

15. The golf putter head of claim 10 wherein at least one of said different ball-impacting characteristics includes a coefficient of friction between a golf ball and said insert.

16. The golf putter head of claim 10 further including at least a second face plate attachable to said body interchangeably with said first face plate.

17. The golf putter head of claim 10 wherein said releasable fastener structure is further defined as comprising in combination at least one screw, at least one hole through one of said face plate and said body, and at least one threaded bore in the other of said face plate and said body, whereby said screw is insertable through said hole and screwable into said threaded bore to thereby secure said plate from movement relative to said body.

18. The golf putter head of claim 10 wherein said releasable fastener structure is further defined as comprising in combination at least one hole through said face plate offset from said ball-impacting regions of said faces thereof, a bore disposed inwardly of said body from a surface thereof, at least one of said hole and said bore being threaded, and a threaded fastener insertable through said hole and threadingly screwable into said bore.

19. The golf putter head of claim 10 further including at least one weight pocket located inwardly of a base wall of said recess spaced inwardly of said body face of said putter head body, said weight pocket being adapted to removably hold therein a weighting member of a selected weight.

20. The golf putter head of claim 19 wherein said weighting member is held within said weight pocket by being pressed between an inner face surface of said face plate and an outer facing base wall of said pocket.

21. A golf putter head for attachment to an elongated shaft provided with a handle grip to thereby constitute a golf putter, said golf putter head comprising;

a. a body which has a lower sole surface, an upper, crown surface spaced above said sole surface, laterally spaced apart toe and heel side surfaces disposed between said sold and crown surfaces, and a front body face disposed between said sole and crown surfaces, said front face surface having formed therein a recess, said recess having a uniform transverse cross-sectional shape in planes parallel to said body face of said putter head body, and an inner base wall, b. at least a first rotatably reversible face plate having at least first and second ball-impacting faces which have therein first and second notches, respectively said first and second notches holding therewithin first and second inserts, respectively, having different ball-impacting characteristics, said first and second ball-impacting faces being located on opposite, first and second sides of said face plate and being parallel to a longitudinal axis of said face plate, said face plate having a pair of laterally opposed, transverse edge walls which are perpendicular to said first and second ball-impacting faces of said face plate, said face plate having an outline shape similar to the outline shape of said recess, and a thickness no greater than the depth of said recess, said face plate being removably insertable into said recess with a first selected ball-impacting face thereof substantially flush with said body face of said body, and the other of said ball-impacting faces is positioned in non-forward-facing, non-ball-impacting orientation and removable from said recess, rotatable about said longitudinal axis of said face plate and returnable to said recess to position a second selected ball-impacting face flush with said body face of said body, and c. a releasable fastener structure which enables said face plate to be removably and reversibly secured within said recess in said body face with a selected one of said ball-impacting faces of said face plate positioned in a forward-facing ball-impacting orientation.

22. The golf putter head of claim 21 wherein said depth of said recess is approximately twice the thickness of said face plate, whereby two of said face plates are stackable within said recess with any selected one of the four ball-impacting faces of the two face plates positioned in a forward-facing ball-impacting orientation.

23. The golf putter head of claim 22 further including a second type reversible face plate having a shape approximating that of a square parallepiped including square transverse end faces between which are disposed laterally disposed, laterally elongated, rectangularly-shaped first, second, third and fourth ball-impacting faces, including a first pair of opposed, first and second ball-impacting surfaces, and a second pair of third and fourth parallel ball-impacting surfaces which are perpendicular to said first pair, whereby said square cross-section face plate is removable and rotatable about a longitudinal axis of said face one-quarter, one-half or three-quarters of a complete revolution to thereby position a different one of said four ball-impacting surfaces in a forward-facing use orientation, and re-installed in said recess.

24. The golf putter head of claim 23 wherein said releasable fastener structure is further defined as comprising in combination;

a. a pair of laterally spaced apart holes through each pair of opposed parallel ball-impacting faces of said face plate, b. a pair of threaded bores which extend inwardly from said inner base wall of said recess, said bores being aligned with said holes when said face plate is inserted conformally into said recess, and c. a pair of threaded fasteners insertable into said holes and screwable into said bores.

25. The golf putter head of claim 23 wherein said releasable fastener structure is further defined as comprising in combination;

a. a pair of laterally spaced apart, laterally disposed, axially aligned holes through said toe and heel sides, respectively, of said body, b. a pair of threaded bores which extend inwardly from opposite transverse end faces of said face plate, said threaded bores being centered in said respective end faces and disposed perpendicularly inwards therefrom, and c. a pair of threaded fasteners insertable into said holes and screwable into said bores.

* * * * *